US009055632B2

(12) United States Patent
Tomasovics et al.

(10) Patent No.: US 9,055,632 B2
(45) Date of Patent: Jun. 9, 2015

(54) BIT PACKER FOR CONTROL SIGNALS

(75) Inventors: Attila Tomasovics, Sun Rosier (SG); Arno Rabenstein, Chancery Grove (SG)

(73) Assignee: INFINEON TECHNOLOGIES AG, Neubiberg (DE)

( * ) Notice: Subject to any disclaimer, the term of this patent is extended or adjusted under 35 U.S.C. 154(b) by 484 days.

(21) Appl. No.: 13/571,592

(22) Filed: Aug. 10, 2012

(65) Prior Publication Data

US 2014/0042927 A1 Feb. 13, 2014

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 33/0815* (2013.01); *H05B 33/0842* (2013.01)

(58) Field of Classification Search

USPC ..... 315/291, 36, 71

See application file for complete search history.

(56) References Cited

U.S. PATENT DOCUMENTS

| | | | | |
|---|---|---|---|---|
| 6,061,399 | A * | 5/2000 | Lyons et al. | 375/240 |
| 6,101,195 | A * | 8/2000 | Lyons et al. | 370/498 |
| 6,330,286 | B1 * | 12/2001 | Lyons et al. | 375/240.28 |
| 7,170,856 | B1 * | 1/2007 | Ho et al. | 370/230 |
| 7,733,151 | B1 * | 6/2010 | Yu et al. | 327/291 |
| 2007/0019547 | A1 * | 1/2007 | Ho et al. | 370/230 |
| 2007/0237284 | A1 * | 10/2007 | Lys et al. | 377/19 |
| 2010/0309185 | A1 * | 12/2010 | Koester et al. | 345/211 |
| 2011/0068689 | A1 | 3/2011 | Scenini et al. | |
| 2011/0291584 | A1 | 12/2011 | Filippo et al. | |
| 2014/0042927 | A1 * | 2/2014 | Tomasovics et al. | 315/291 |

FOREIGN PATENT DOCUMENTS

| | | | |
|---|---|---|---|
| EP | 2230885 | A1 | 9/2009 |

* cited by examiner

*Primary Examiner* — Adam Houston
(74) *Attorney, Agent, or Firm* — SpryIP, LLC

(57) ABSTRACT

Representative implementations of devices and techniques provide a bit packing arrangement for a control signal. The control signal is received as a bit stream having a first rate of change. A packed control signal having a varying rate of change may be generated based on the bit stream. The average rate of change of the packed control signal is less than the first rate of change.

26 Claims, 8 Drawing Sheets

BIT PACKER FOR CONTROL SIGNALS

BACKGROUND

With the proliferation of light-emitting-diode (LED) lamps, as well as other types of lamps, there are many applications which include dimming the lamps and changing the color of the lamps. For example, it is often desirable for LED lamps in residential and commercial applications to be dimmable (i.e., have an adjustable brightness). Additionally, it may be desirable for LED lamps to have the capability to change colors when used in instrumentation, user interface displays, and other information-related applications. Further, display screens for information or entertainment applications make use of LED lamps that dim and/or change colors.

In some applications, drivers, which may be switch-mode drivers, linear drivers, or the like, are used to control the current to the lamp. In such setups, the average current, and therefore the brightness of the lamp, can be controlled based on receiving a control signal at the enable input of the driver. Often, these drivers have a limited input bandwidth, where the enable signal is not allowed to change quickly, the driver needing a minimum time to stabilize at each input level (e.g., on-time and off-time) between switching. For example, some drivers have a minimum stable time of 10 microseconds, or the like. This minimum stable time can be longer for high power LED lamp drivers.

Additionally, many control systems that feed a binary control signal to the drivers operate at much higher frequencies, often causing electro-magnetic compatibility (EMC) issues for the associated devices. On the other hand, the bit rate for a lamp control system needs to be high enough to help the human eye low-pass filter the lamp output, to avoid the appearance of lamp flickering. In other words, the bit rate needs to be higher than the flicker fusion threshold so that the light stimulus appears steady to the human eye due to persistence of vision. Further, a sufficiently high bit rate ensures that the system has an adequate overall bandwidth. In some applications, each of these requirements conflict with one another.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure.

DETAILED DESCRIPTION

Overview

Representative implementations of devices and techniques provide a bit packing arrangement for a binary control signal. The control signal may be used with a driver to vary the intensity of a lamp, change the color of the lamp, and the like. For example, multiple control signals may be used to vary the intensity of multiple components of a lamp concurrently, thereby changing the overall color and/or brightness of the lamp. The bit packing arrangement provides a reorganized (i.e., packed) signal to the driver, that is compatible with the driver and the system, and carries the information of the input control signal.

In an implementation, a control signal in the form of a bit stream having a first rate of change is received at a bit packer. A packed control signal based on the bit stream is generated and may be output to a driver device, for example. In one implementation, the packed control signal is comprised of packets. The packed control signal has a varying rate of change, where the mean rate of change of the packed control signal is less than the mean of the first rate of change (i.e., the mean of the bit stream rate of change).

Some implementations include multiple channels for controlling several components of a system (e.g., multiple lamp components for individual colors, etc.). Multiple bit packers may be used with multiple control signals, where each control signal channel includes a bit packer. In one implementation, a bit packer outputs a packed control signal via a spread spectrum output.

Various implementations and techniques for a bit packer arrangement are discussed in this disclosure. Techniques and devices are discussed with reference to example light-emitting-diode (LED) lamps, devices, and systems. However, this is not intended to be limiting, and is for ease of discussion and illustrative convenience. The techniques and devices discussed may be applied to any of various lamp device designs, types, and the like (e.g., liquid-crystal-display (LCD), polyvinyl-alcohol (PVA) display, piezoelectric material display, electron-stimulated lamps, incandescent lamps, electroluminescent (EL) lamps, etc.), as well as other continuously variable control systems that utilize one or more control signals, and remain within the scope of the disclosure.

Implementations are explained in more detail below using a plurality of examples. Although various implementations and examples are discussed here and below, further implementations and examples may be possible by combining the features and elements of individual implementations and examples.

Example Brightness Control Arrangement

Figure 1:
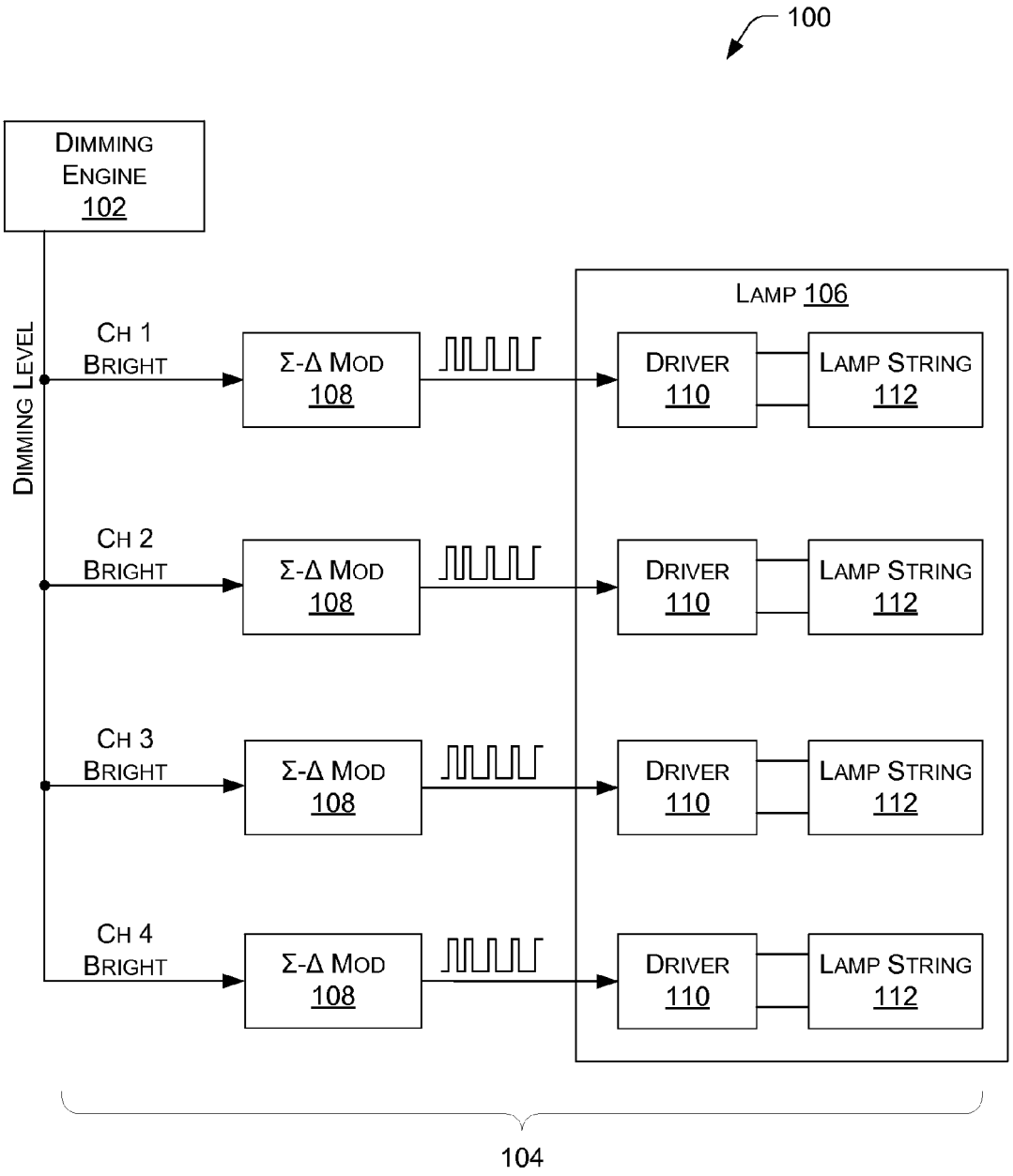
FIG. 1 is a block diagram of an example multi-channel brightness/color control arrangement for a lamp, in which the techniques described herein may be employed, according to an implementation.

FIG. 1 is a block diagram of an example multi-channel brightness/color control arrangement 100, in which the techniques described herein may be employed, according to an implementation. For example, the multi-channel brightness/color control arrangement 100 may be arranged to vary the brightness of a lamp, change the color of the lamp, and the like.

As illustrated in FIG. 1, an example multi-channel brightness/color control arrangement 100 may include one or more dimming engines 102, a quantity of channels 104, and a lamp 106, for example. In alternate implementations, fewer, additional, or alternative components may be included. For example, in various implementations, a multi-channel brightness/color control arrangement 100 may include fewer or more channels 104 than are illustrated in FIG. 1.

If included, a dimming engine 102 receives a dimming level value from a user for example, and distributes the dimming level value to each of the channels 104. In alternate implementations, the dimming level may be received from another source, such as from an output of a process, or the like. In some implementations, the dimming level is a binary value, an integer, or other similar value. The dimming level value determines the overall brightness of the lamp.

In an implementation, the relative dimming values of each channel 104 may also determine the color of the lamp 106. For example, each of the channels 104 may represent a color (i.e., red, green, and blue for a three-color/channel lamp). A combination of a greater intensity on one or more of the channels 104 and a lesser intensity on remaining channels 104 results in a particular overall brightness and/or color of the lamp. Subsequently changing the intensity value of one or more of the channels 104 changes the color or overall brightness of the lamp.

In an implementation, each of the channels 104 may include a modulator 108. The modulator 108 is arranged to receive the dimming level value (a.k.a. brightness value, e.g., ch 1 bright, ch 2 bright, ch 3 bright, ch 4 bright) from the dimming engine 102. In an implementation, the modulator 108 converts the brightness value to a high frequency bit stream. The bit streams from the channels 104 are the input signals to the lamp 106. In an implementation, the mean value of a bit stream corresponds to the brightness value at the input of the respective modulator 108. For the purposes of this disclosure, a bit stream may be described as a digital approximation of an analog input. For example, a bit stream may include a digital representation that is proportional to the magnitude of the voltage or current of the analog input, over a selected duration. The digital representation may be expressed in various ways (e.g., base 2 binary code, binary coded decimal, voltage values, electrical or light pulse attributes, and the like).

In one implementation, the modulator 108 is a sigma-delta modulator. Sigma-delta modulated currents from the modulator 108 result in a sigma-delta modulated brightness level at the lamp 106. Since the human eye has a limited bandwidth, it low-pass filters the varying brightness level output by the sigma-delta modulator 108. If the bit rate is sufficiently high, the eye senses the mean brightness of the lamp 106 that is dependent on the signal output from the sigma-delta modulator 108. In alternate implementations, other techniques and/or devices may be used to convert the brightness value output at the dimming engine 102 to an input signal for the lamp 106. Further, in alternate implementations, the channels 104 may include alternate or additional components to control the brightness and/or color of the lamp 106.

In various implementations, the modulator 108 may be bypassed when a brightness value is output from the dimming engine 102 that represents nearly 0% or nearly 100% of the lamp 106 capacity or control signal level. In that case, a corresponding brightness value signal may be fed to the lamp 106 directly. For example, if the desire is for the lamp 106 to be off (e.g., a control signal value near 0%), there is no need for a modulated signal to be sent to the lamp 106. Rather, an off signal (or the lack of any brightness signal) may be sufficient to turn the lamp off. Conversely, if the desire is for the lamp to be at or near 100%, there is no need for a modulated signal to be sent to the lamp 106 then either. Rather, a signal representing full capacity may be sent directly to the lamp 106, bypassing the modulator 108.

In alternate implementations, various dimming and/or brightness levels may be assigned to be treated as nearly 0% (e.g., 0-3%) and nearly 100% (e.g., 97-100%) for the purposes of bypassing the modulator 108. In other implementations, other values and/or ranges may be used, corresponding to the application.

As discussed above, the lamp 106 may be an LED lamp, another type of lamp, or another controlled system that uses variable control signals. In one implementation, changes to the brightness level value at one or more of the channels 104 changes the brightness and/or color of the lamp 106.

If included, the lamp 106 may use one or more drivers 110 to control one or more lamp strings 112. A driver 110 may be arranged to receive a control signal from a modulator 108, and to control the current to the lamp string(s) 112, based on the control signal. In various implementations, as illustrated in FIG. 1, each channel of a multi-channel brightness/color control arrangement 100 may include a driver 110 and a lamp string 112.

In alternate implementations, a multi-channel brightness/color control arrangement 100 may include fewer, additional, or alternate components.

Figure 2:
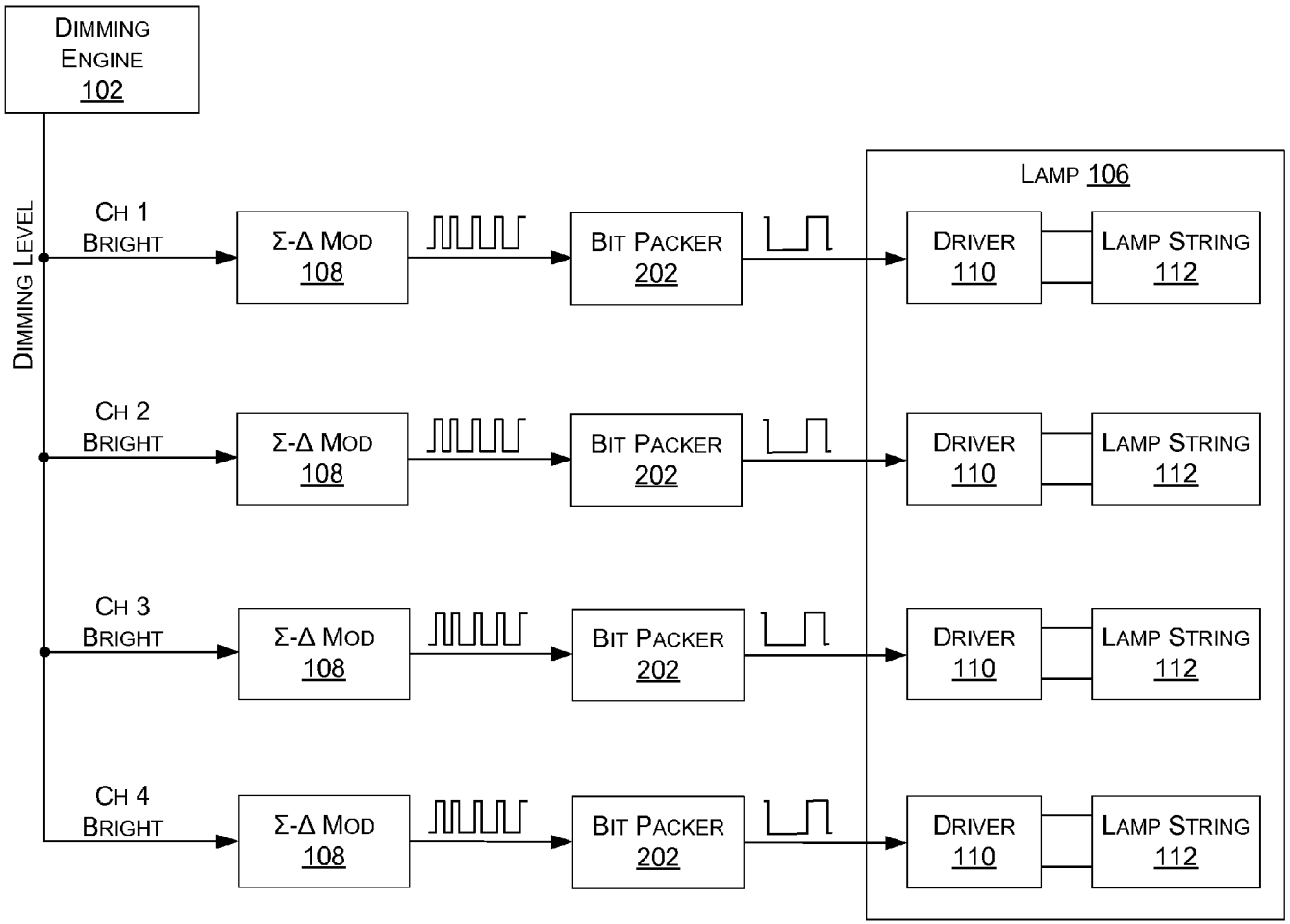
FIG. 2 is a block diagram of the example brightness/color control arrangement of FIG. 1, including a bit packer at each channel, according to an implementation.

FIG. 2 is a block diagram of the example brightness/color control arrangement of FIG. 1, including a bit packer 202 at each channel, according to an implementation. As shown in the illustration of FIG. 2, the bit packer may be used in a channel 104 between the modulator 108 (or other control signal device) and the driver 110. In one implementation, the bit packer 202 receives a bit stream having a first rate of change from the modulator 108, and generates a packed control signal based on the bit stream. In the implementation, the packed control signal has a constantly varying rate of change and an average rate of change that is less than the first rate of change (i.e., the rate of change of the output of the modulator 108). In an implementation, the bit packer 202 is arranged to control a rate of change of the color and/or the brightness of a lamp 106, the intensity of a control system signal, and/or the like.

In an example, the control system driver 110 receives the packed control signal from the bit packer 202 and controls the intensity of a variable load, such as the lamp string 112 or the lamp 106, based on the packed control signal. For example, the control system driver 110 may control the brightness, color, and the like, of the lamp 106 or lamp components via the packed control signal. A mean value of the packed control signal may correspond to a brightness level, a color intensity, etc. of the lamp 106 or lamp component(s).

In an implementation, the packed control signal comprises one or more packets. The packets are representative of the information in the bit stream, in a reorganized form. For example, each packet includes a first set of consecutive off-bits and a second set of consecutive on-bits, representing the off-bits and on-bits of the bit stream. In one implementation, either the first set of off-bits has a quantity of off-bits that is equal to a preselected off-value or the second set of on-bits has a quantity of on-bits that is equal to a preselected on-value. Thus, a packet either has a fixed set of off-bits and a variable number of on-bits or a fixed number of on-bits and a variable number of off-bits. The preselected off-value and preselected on-value may be user-selected and/or user-adjusted, and are used to determine the length of the off-time or on-time within packets, thereby influencing the length of the packets, as is discussed further below.

Example Bit Packer

Figure 3:
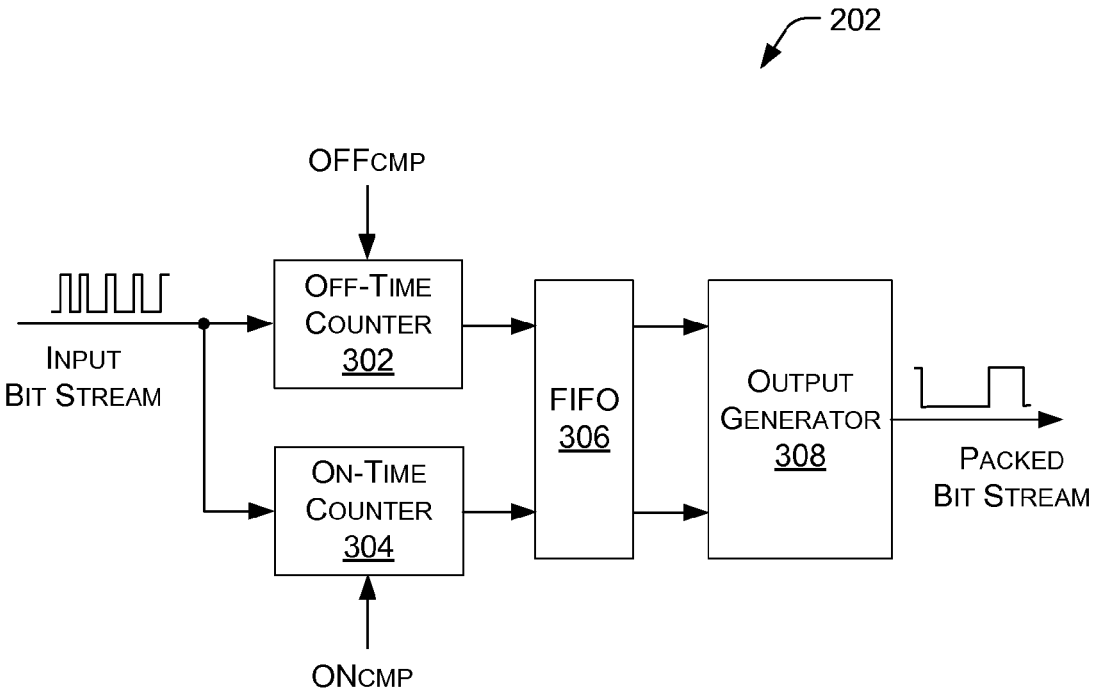
FIG. 3 is a block diagram of an example bit packer, according to an implementation.

FIG. 3 is a block diagram of an example bit packer 202, according to an implementation. The bit packer 202 illustrated in FIG. 3 is shown as a single channel 104 arrangement. In various implementations, multiple bit packers 202 may be used to provide packed control signals for multiple channels 104 of a multi-channel brightness/color control arrangement 100, as shown in FIG. 1 for example. In an implementation, as illustrated in FIG. 3, a bit packer 202 may include one or more hardware devices, including one or more counters (302, 304), a buffer device 306, and a packet generator (a.k.a. output generator) 308. In alternate implementations, the bit packer 202 may include fewer, additional, or alternate components and remain within the scope of the disclosure. Further, one or more of the components of a bit packer 202 may be integrated into a single device or multiple devices.

If included, the one or more counters (302, 304) are arranged to receive the bit stream from the modulator 108, for example. In an implementation, the bit stream has a first rate of change (which may be based on a system clock, the modulator 108, or another timing source). The one or more counters (302, 304) count the off-bits and count the on-bits of the bit stream. In an implementation, as illustrated in FIG. 3, the off-time counter 302 counts the off-bits and the on-time counter 304 counts the on-bits. In alternate implementations, the off-bits and the on-bits may be counted by a single device, or alternate devices. The one or more counters (302, 304) count bits until a count of off-bits is equal to a preselected off-value (OFFcmp) or a count of on-bits is equal to a preselected on-value (ONcmp). When either the count of off-bits reaches OFFcmp or the count of on-bits reaches ONcmp, a packet is formed based on the counts from the counters (302, 304) as described below.

Figure 4:
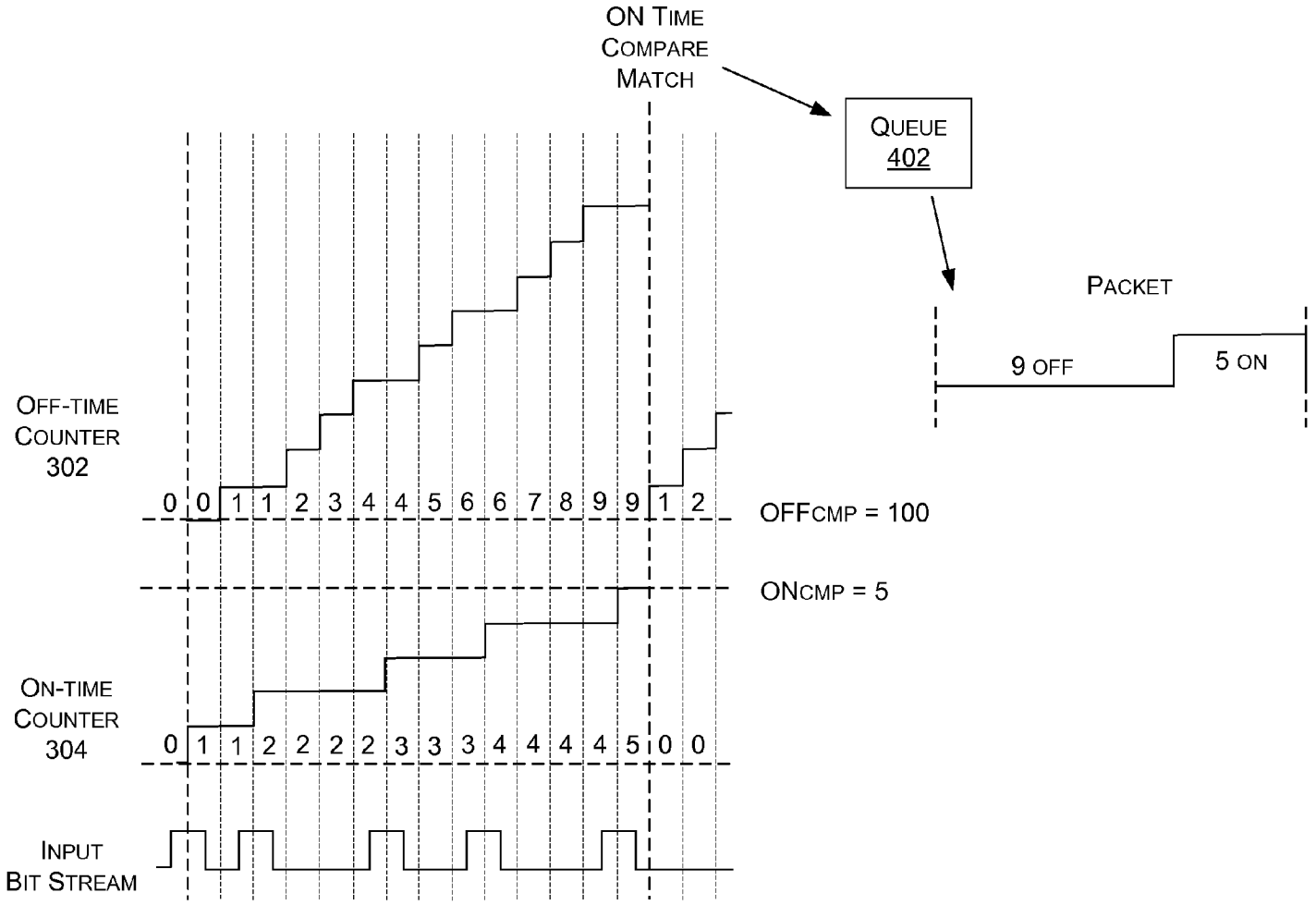
FIG. 4 is a graphic illustrating an example of bit packing, including an input bit stream, intermediate signals, and a packed bit stream, according to an implementation.

FIG. 4 is a graphic illustrating an example of bit packing, including an input bit stream, intermediate counts, and a packed bit stream (or packed control signal), according to an implementation. As illustrated in FIG. 4, the input bit stream includes a series of random or pseudo-random off-bits and on-bits. The input bit stream may be periodic. In general, the input bit stream may be any signal type. An average value of the bit stream represents a brightness level intended for the lamp 106. The bit stream may be switching at a high frequency, such as 40 kHz, for example, based on a 25 microsecond bit time, for example.

The counts of two counters (302 and 304) are shown above the input bit stream. In the illustration, the off-time counter 302 counts with each off-bit (low, zero, etc.) of the binary input bit stream and the on-time counter 304 counts with each on-bit (high, one, etc.) of the binary input bit stream.

In the example shown, the value of ONcmp is 5 and the value of OFFcmp is 100, for example. Accordingly, both counters (302, 304) count until one of the counters (302, 304) reaches its corresponding preselected value (i.e., OFFcmp, ONcmp respectively). In the example shown, the on-time counter 304 reaches a count of 5 prior to the off-time counter 302 reaching 100. At the time the on-time counter 304 has reached a count of 5, the off-time counter 302 has counted to 9. The values for the counts from the counters (302, 304) are (9, 5) respectively at that moment. Those counts may be held in a queue 402 temporarily, and then used to generate a packet as illustrated in FIG. 4. As also shown in the illustration of FIG. 4, the counters (302, 304) are reset after outputting the counts, and they begin counting off-bits and on-bits for the next packet. Accordingly, a packed bit stream (i.e., packed control signal) comprises multiple packets.

In the illustrated case, the packet contains 9 consecutive off-bits and 5 consecutive on-bits, based on the respective counts of the counters (302, 304). In an implementation, as shown in FIG. 4, the packet represents the information of the input bit stream, in a reorganized form.

In an implementation, the bit packer 202 generates a packet with the off-bits grouped together and the on-bits grouped together. This grouping arrangement allows the input bit stream information (which may be at a high bit rate) to be passed to the driver 110 in a compatible manner (e.g., at an average rate of change that allows the driver 110 to stabilize between switching events). In alternate implementations, the on-bits may be arranged to follow the off-bits in a packet, as shown in FIG. 4, or the on-bits may be arranged to lead the off-bits in a packet. In other implementations, other bits may be included with the packet (e.g., for signaling, etc.).

As described above, consecutive or subsequent packets may have random or varying lengths, based on a quantity of bits counted by one counter (302 or 304) when the other counter (304 or 302) has reached its associated preselected value (OFFcmp, ONcmp). This is especially noticeable when the preselected values (OFFcmp, ONcmp) are selected/adjusted to be large. For example, in an implementation, the value of OFFcmp equals 218 and the value of ONcmp equals 39. In that implementation, the range of packet lengths can be from 39 bits (0 off-bits and 39 on-bits) to 256 bits (218 off-bits and 38 on-bits). In alternate implementations, the values of OFFcmp and ONcmp can be various other values, determining a different range of packet lengths.

In an implementation, the rate of change of the packed control signal (e.g., packed bit stream) output by the bit packer 202 is constantly varied and random. This is due to the different varying lengths of consecutive packets that make up the packed control signal. Accordingly, the packed control signal has no regular duty cycle. However, in an implementation, the average rate of change of the packed control signal is less than the average rate of change of the input bit stream. This is because the bit packer 202 groups the off-bits and groups the on-bits to make up the packets, thereby reducing the quantity of switching cycles for the same number of bits.

In one implementation, the varying rate of change of the packed control signal provides a spread spectrum output from the bit packer 202. The spread spectrum output can be viewed as a frequency band with a center frequency. In an implementation, the spread spectrum output lessens, if not eliminates, electro-magnetic compatibility issues among the components of the system.

In an implementation, the preselected values OFFcmp and/or ONcmp may be user-selectable and/or user-adjustable. Selection of the preselected values OFFcmp and/or ONcmp determines how a brightness value is represented by the packet. For example, if all packets were the same (essentially never true), the formula for the brightness level would be: brightness=[ONcmp/(Oncmp+OFFcmp)]×100%.

In an implementation, the brightness (or intensity) level represented by a packet is based on the ratio of off-bits to on-bits. For example, if the value of OFFcmp is 218 and the value of ONcmp is 39, and the packet contains 39 off-bits and 39 on-bits, the brightness level represented is 50% brightness. Fewer off-bits paired with the 39 on-bits means that the packet represents a brighter value and more off-bits paired with the 39 on-bits means that the packet represents a less-bright value.

In one implementation, selection of the preselected values OFFcmp and/or ONcmp also determines a frequency range for the output of the bit packer 202, and adjustment of one or more of the preselected values OFFcmp and/or ONcmp adjusts one or more of the limits of the frequency range of the output. For example, the minimum packet time is: $PacketTime_{min}=ONcmp\times(1/f_{bit})$, where $f_{bit}$ is the clock determining the bit time (e.g., 40 kHz for a 25 microsecond bit time, etc.). The maximum packet time is: $PacketTime_{max}=[(ONcmp+OFFcmp)\times(1/f_{bit})]$. The maximum instantaneous frequency is: $f_{max}=f_{bit}/(ONcmp+1)$.

To avoid the appearance of lamp 106 flicker, it is not desirable for the average rate of change of the bit packer 202 output to be too low. Accordingly, it is desirable to set the value of OFFcmp at a reasonable value to avoid too low of an output frequency. For example, when the intended brightness (or intensity) of the lamp 106 is very low (5%, for example) a large quantity of off-bits may be counted (and grouped into a packet) before the preselected value (ONcmp) for on-bits is reached. Thus, a reasonable value may be selected for OFFcmp (e.g., 218, etc.) to avoid an overly low output frequency. When the off-time counter 302 reaches 218, for example, a packet is generated using the 218 off-bits and the quantity of on-bits counted by the on-time counter 304. More on-bits coupled to the 218 off-bits in a packet results in a lower frequency (and represents a greater brightness) and fewer on-bits coupled to the 218 off-bits results in a higher frequency (and represents a lesser brightness).

Referring to FIG. 3, if included, the packet generator (a.k.a. output generator) 308 is arranged to generate a packet based on the counts of the one or more counters (302, 304). In an implementation, as described above, the packet includes a set of consecutive off-bits, the set having a quantity of off-bits equal to the count of off-bits by the off-time counter 302, and a set of consecutive on-bits, the set having a quantity of on-bits equal to the count of on-bits by the on-time counter 304. The packet generator 308 outputs the generated packet. In an implementation, the packet generator 308 outputs the packet to the driver 110, or the like.

Figure 5:
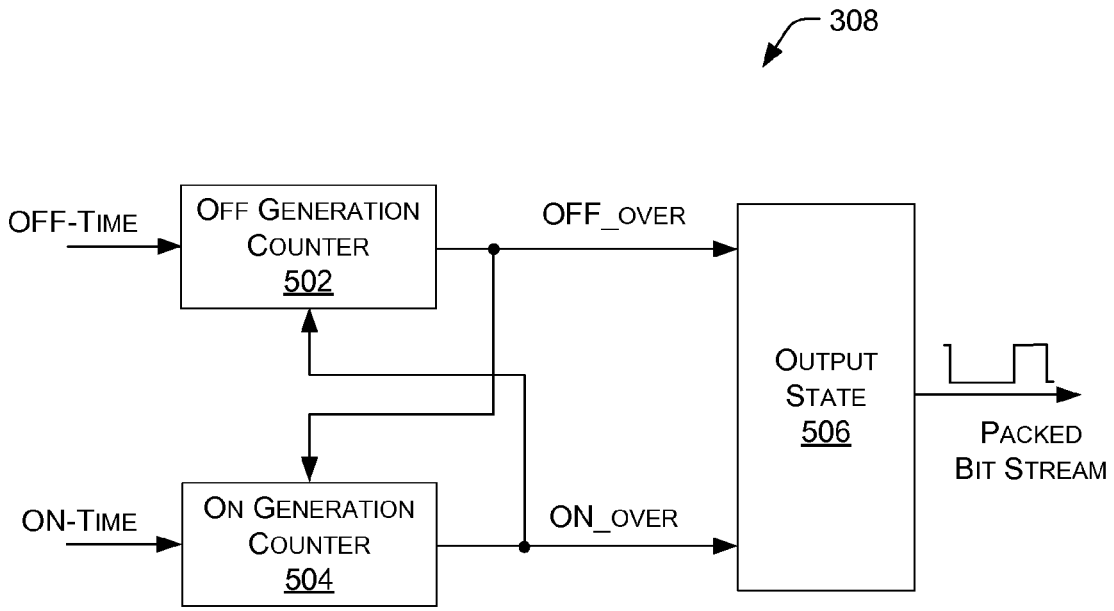
FIG. 5 is a block diagram of an example packet generator, which may be employed with the bit packer of FIG. 3, for example, according to an implementation.

FIG. 5 is a block diagram of an example packet generator 308, which may be employed with the bit packer 202, for example, according to an implementation. For example, the packet generator 308 may receive the count of off-bits and the count of on-bits from the one or more counters (302, 304) and generate a packet based on the counts received. In one implementation, as illustrated in FIG. 5, the packet generator includes one or more counters (502, 504) and an output state device 506.

If included, an off-generation counter 502 may be arranged to generate the set of consecutive off-bits for the packet, based on receiving the count of the off-time counter 302, for example. If included, an on-generation counter 504 may be arranged to generate the set of consecutive on-bits for the packet, based on receiving the count of the on-time counter 304, for example. Also, if included, an output state device 506 may be arranged to organize the set of consecutive off-bits and the set of consecutive on-bits to form the packet, and to output the packet. The output state device 506 may be arranged to organize the set of consecutive off-bits followed by the set of consecutive on-bits, or vice versa. In one implementation, the output state device 506 may be arranged to organize a packet such that the set of consecutive off-bits is followed by the set of consecutive on-bits for safety protocols, for example (e.g., the packet starts in an off-state), or the like.

In one implementation, the packet generator 308 is arranged to output the packet as discussed above: via another stream (i.e., the packed bit steam, packed control signal) having a variable rate of change with a lesser average rate of change than the first rate of change (i.e., the rate of change of the input bit stream). The variable rate of change is based on at least one of the preselected off-value (OFFcmp) and the preselected on-value (ONcmp). A mean value of the packet is equal to a mean value of the input bit stream.

Referring to FIG. 3, the bit packer 202 may also include a buffer device 306. If included, the buffer 306 may be arranged to receive and to temporarily store the count of off-bits and the count of on-bits from the one or more counters (302, 304). Further, the buffer 306 may be arranged to output the count of off-bits and the count of on-bits to the packet generator 308. In an implementation, the queue 402 of FIG. 4 comprises the buffer 306.

In various implementations, the buffer 306 may have multiple stages (e.g., 4 stages, etc.). The buffer 306 may store several sets or pairs of counts in the multiple stages, based on the speed of the output with respect to the speed of the input of the bit packer 202. In an implementation, the buffer 306 is a first-in-first-out (FIFO) buffer device so that the packets are generated in an order corresponding to the input bit stream. This ensures that changes to the desired brightness/color/intensity of the lamp 106 are carried from the input of the bit packer 202 through to the driver 110 and the lamp 106 (or lamp strings 112).

In various implementations, the bit packer 202, including some or all of its components, may be implemented in hardware devices such as one or more digital logic components (e.g., counters, inverters, flip-flops, state machines, etc.) and the like.

As discussed above, the techniques, components, and devices described herein with respect to the bit packer 202 are not limited to the illustrations in FIGS. 3 through 5, and may be applied to other devices and designs without departing from the scope of the disclosure. In some cases, additional or alternative components may be used to implement the techniques described herein. Further, the components may be arranged and/or combined in various combinations, while resulting in the packed control signal output. It is to be understood that a bit packer 202 may be implemented as a standalone device or as part of another system (e.g., integrated with other components, systems, etc.).

Example Implementations

Figure 6:
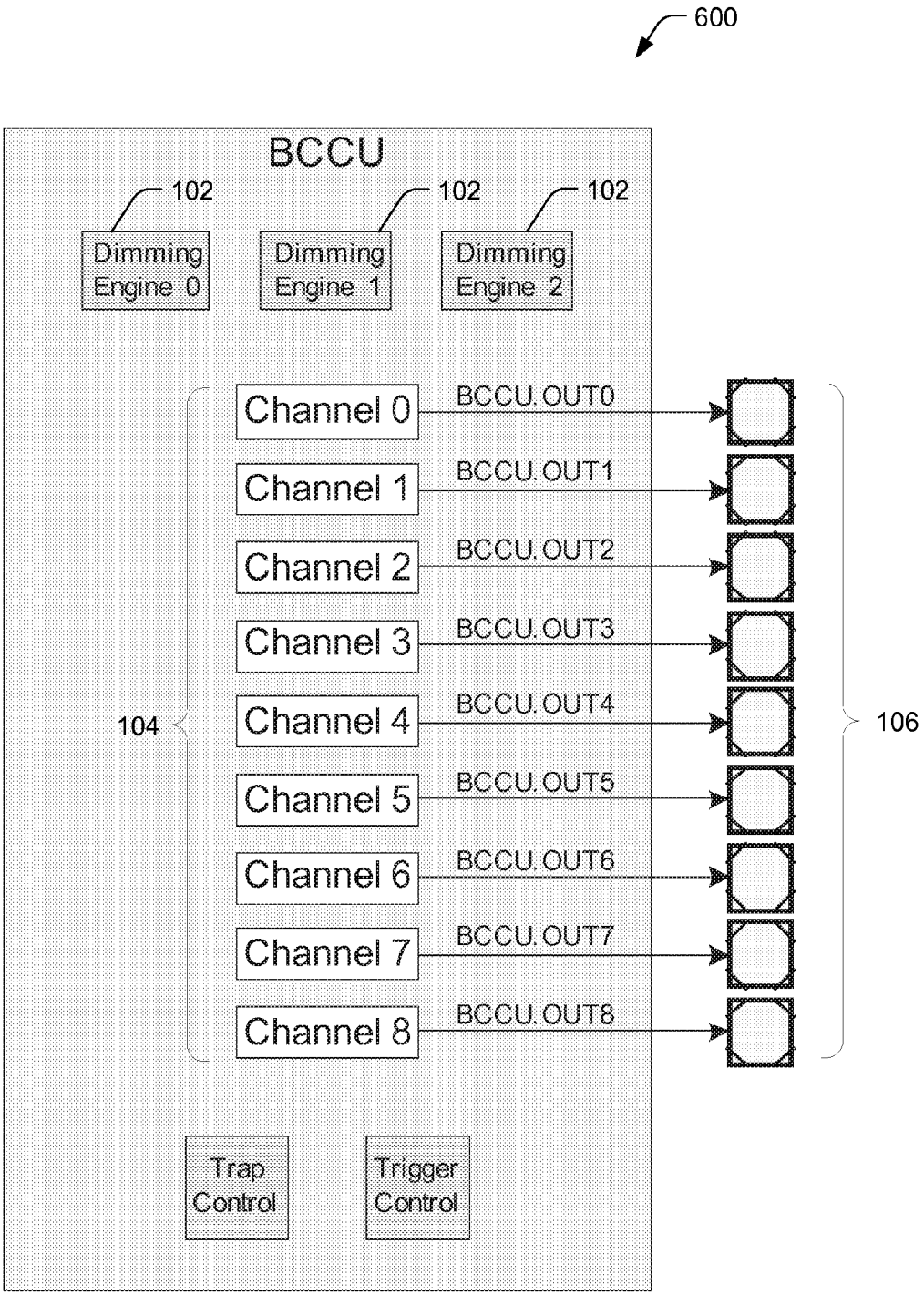
FIG. 6 is a block diagram of an example integrated brightness and color control unit (BCCU), which may incorporate a bit packer on one or more channels, according to an implementation.

As discussed previously, multiple bit packer 202 arrangements may be used to provide packed control signals to multiple channels 104 of a lamp 106 (or other control system having multiple control signals). FIG. 6 shows a block diagram of an example brightness and color control unit (BCCU) 600, which may incorporate multiple bit packers 202, according to an implementation. In various implementations, the components of a bit packer 202 may be distributed. In the example shown in FIG. 6, the BCCU 600 includes at least 9 channels 104. In an example, each of the 9 channels 104 may include a bit packer 202 (as shown in FIG. 6) as part of a multi-channel brightness/color control arrangement 100. Additionally, some or each of the 9 channels 104 may be used to control the color and/or brightness of a lamp 106 or another type of control system using multiple control signals. In alternate implementations, a BCCU 600 may include fewer or additional channels 104, or components.

Figure 7:
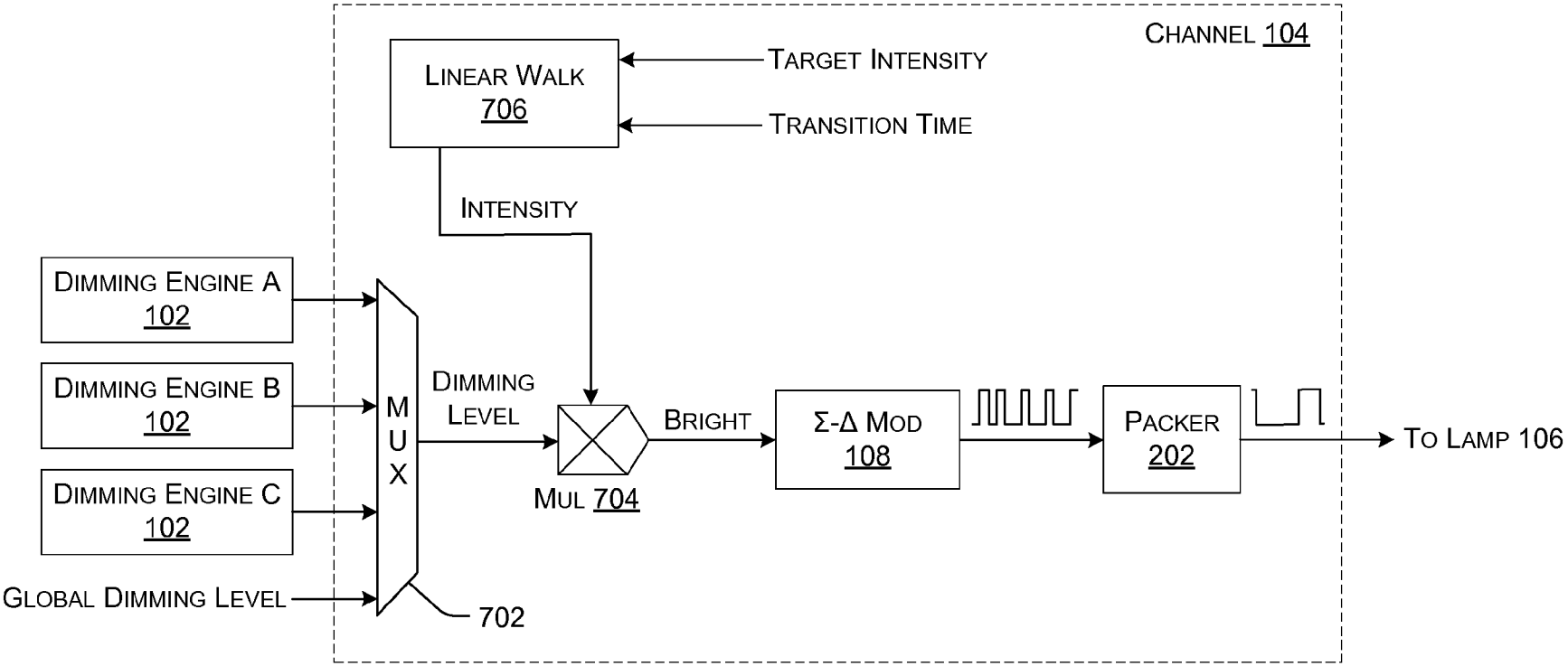
FIG. 7 is a block diagram showing example components of a channel, which may be employed as part of the BCCU of FIG. 6, for example, according to an implementation.

FIG. 7 is a block diagram showing example components of a channel 104, which may be employed as part of the BCCU 600 of FIG. 6, for example, according to an implementation. The example channel 104 may include some or all of the components discussed with respect to the example multi-channel brightness/color control arrangement 100. In alternate implementations, the channel 104 may include additional or alternate components.

As illustrated in FIG. 7, an example channel 104 may include multiple dimming engines 102 that may be multiplexed (at MUX 702) to form a single dimming level, for example. In an implementation, the MUX 702 may select the output of one dimming engine 102 as the input signal of the channel 104. In various implementations, the MUX 702 may alternate selection of the dimming engine 102 outputs, for example. Additionally, a global dimming level may also be multiplexed with individual dimming outputs from the dimming engines 102. The resulting dimming level output from the MUX 702 may be combined at a multiplier 704, for example, with a channel intensity value, as illustrated in FIG. 7. For example, the intensity value may be output from a linear walk arrangement 706, arranged to linearly transition changes in intensity.

As shown in FIG. 7, and discussed above, a modulator 108 receives the brightness signal, and the output of the modulator 108 is a high frequency bit stream. In an implementation, a bit packer 202 is arranged to receive the bit stream, and output a packed control signal (i.e., packed bit stream) that is more easily used by the lamp 106, lamp driver 110 (not shown), or the like. For example, the bit packer 202 may convert the high frequency bit stream to another digital form with a varying rate of change.

In alternate implementations, such as the implementation of FIG. 7, various channel 104 configurations may be employed to provide brightness and/or color control to the lamp 106, or the like. In each of these channel 104 configurations, a bit packer 202 can be used to supply a packed control signal (i.e., packed bit stream), as described above.

In various implementations, additional or alternative components may be used to accomplish the disclosed techniques and arrangements.

Representative Process

Figure 8:
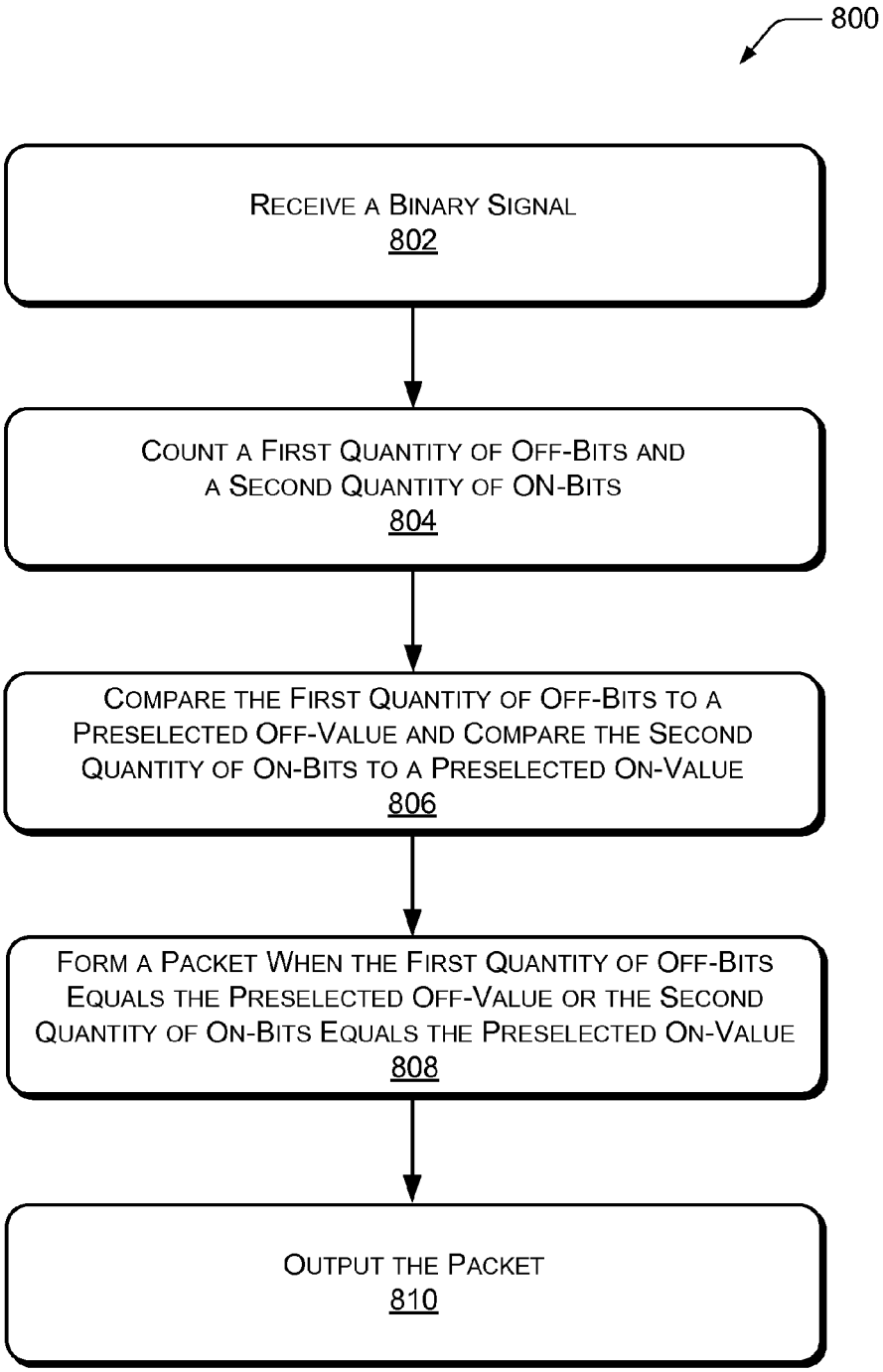
FIG. 8 is a flow diagram illustrating an example process for reorganizing control signal information, according to an implementation.

FIG. 8 is a flow diagram illustrating an example process 800 for reorganizing control signal information for a binary control signal, such as for a brightness component of a lamp (e.g., lamp 106), according to an implementation. The process 800 describes counting a quantity of off-bits and a quantity of on-bits of the control signal. A packet is formed when one of the quantities reaches a preselected value, for example. In one example, the packets are output at a variable rate of change. The process 800 is described with reference to FIGS. 1-7.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable materials, or combinations thereof, without departing from the scope of the subject matter described herein.

At block 802, the process includes receiving a binary signal (i.e., input bit stream) having a first rate of change. In an implementation, the binary signal is received by a bit packer (such as bit packer 202, for example), and may be received from a modulator (such as modulator 108, for example) or another control signal source. In an example, the first rate of change is a high frequency (such as 40 kHz, for example), and may not be fully compatible with the application (e.g., a driver, the EMC standards, etc.) based on the high rate of change.

At block 804, the process includes counting a first quantity of off-bits and a second quantity of on-bits of the binary signal. In an implementation, one or more counters (such as counters 302 and 304, for example) are arranged to count the first quantity of off-bits and the second quantity of on-bits.

At block 806, the process includes comparing the first quantity of off-bits to a preselected off-value (such as OFFcmp, for example) and comparing the second quantity of on-bits to a preselected on-value (such as ONcmp, for example). In one implementation, one or both of the preselected off-value and the preselected on-value are user-selectable and/or user-adjustable.

At block 808, the process includes forming a packet when the first quantity of off-bits equals the preselected off-value or the second quantity of on-bits equals the preselected on-value. For example, when either count (off-bits or on-bits) is equal to the associated respective preselected value, the count of both off-bits and on-bits stops. In an implementation, the counts (i.e., first quantity of off-bits and the second quantity of on-bits) are output to a packet generator (such as packet generator 308, for example), which generates a packet based on the counts (e.g., forms the packet based on the first quantity of off-bits and the second quantity of on-bits).

In an implementation, the packet includes a set of consecutive off-bits having an amount of off-bits equal to the first quantity of off-bits and a set of consecutive on-bits having an amount of on-bits equal to the second quantity of on-bits. In one implementation, the packet comprises the first quantity of off-bits followed by the second quantity of on-bits. In another implementation, the packet comprises the second quantity of on-bits followed by the first quantity of off-bits.

In one implementation, the process includes resetting the first quantity of off-bits and the second quantity of on-bits after outputting the first quantity of off-bits and the second quantity of on-bits to the packet generator. For example, once the counter(s) have output the respective count values to the packet generator, the counter(s) are reset and begin counting off-bits and on-bits of the input bit stream for the next packet.

In another implementation, the process includes temporarily storing one or more pairs of counts, wherein a pair of counts comprises a first quantity of off-bits and a second quantity of on-bits. For example, the pairs of counts may be stored in a storage device (such as buffer 306, for example) having one or more stages.

At block 810, the process includes outputting the packet. For example, the packet may be output to a driver (such as driver 110, for example) to control a lamp (such as lamp 106, for example).

In one implementation, the process includes outputting the packet via a second binary signal (i.e., a packed control signal, packed bit stream) having a constantly varying rate of change and a lesser average rate of change than the first rate of change (i.e., the rate of change of the input bit stream).

In another implementation, the process includes outputting the packet via a spread spectrum output having a frequency range based on at least one of the preselected off-value and the preselected on-value. For example, the spread spectrum output shapes the switching frequency of the output packed control signal, improving EMC properties. In an implementation, the process further includes adjusting an upper limit of the frequency range by adjusting the preselected on-value.

In one implementation, the process includes outputting subsequent packets based on the binary signal (i.e., input bit stream), where the subsequent packets have varying quantities of bits. For example, subsequent packets may have different lengths as discussed above.

In alternate implementations, other techniques may be included in the process 800 in various combinations, and remain within the scope of the disclosure.

Conclusion

Although the implementations of the disclosure have been described in language specific to structural features and/or methodological acts, it is to be understood that the implementations are not necessarily limited to the specific features or acts described. Rather, the specific features and acts are disclosed as representative forms of implementing example devices and techniques.

What is claimed is:

1. A hardware device, comprising:

one or more counters arranged to receive a bit stream having a first rate of change, and to count off-bits and count on-bits of the bit stream until a count of off-bits is equal to a preselected off-value or a count of on-bits is equal to a preselected on-value; and a packet generator arranged to generate a packet including a set of consecutive off-bits having a quantity of off-bits equal to the count of off-bits and a set of consecutive on-bits having a quantity of on-bits equal to the count of on-bits, and to output the packet.

2. The device of claim 1, the packet generator further comprising:

an off-generation counter arranged to generate the set of consecutive off-bits;

an on-generation counter arranged to generate the set of consecutive on-bits; and an output state device arranged to organize the set of consecutive off-bits and the set of consecutive on-bits to form the packet, and to output the packet.

3. The device of claim 1, further comprising a buffer arranged to receive and to temporarily store the count of off-bits and the count of on-bits from the one or more counters and to output the count of off-bits and the count of on-bits to the packet generator.

4. The device of claim 1, wherein at least one of the preselected off-value and the preselected on-value are user-selectable or user-adjustable.

5. The device of claim 1, wherein the packet generator is arranged to output the packet via another stream having a variable rate of change with a lesser average rate of change than the first rate of change.

6. The device of claim 5, wherein the variable rate of change is based on at least one of the preselected off-value and the preselected on-value.

7. The device of claim 1, wherein the packet comprises the set of consecutive off-bits followed by the set of consecutive on-bits.

8. The device of claim 1, wherein consecutive generated packets have random lengths.

9. The device of claim 1, wherein a mean value of the packet is equal to a mean value of the bit stream.

10. The device of claim 1, wherein the device is arranged to control a rate of change of at least one of a color and a brightness of a lamp.

11. A system implemented in hardware, comprising:

a bit packer arranged to receive a bit stream having a first rate of change, and to generate a packed control signal based on the bit stream, the packed control signal having a constantly varying rate of change and an average rate of change that is less than the first rate of change; and a control system driver arranged to receive the packed control signal and to control an intensity of a variable load, based on the packed control signal.

12. The system of claim 11, wherein the packed control signal comprises one or more packets, each packet including a first set of consecutive off-bits and a second set of consecutive on-bits, the first set having a quantity of off-bits equal to a preselected off-value or the second set having a quantity of on-bits equal to a preselected on-value.

13. The system of claim 11, wherein the variable load comprises a lamp component, and wherein the control system driver is arranged to control at least one of a brightness and a color of the lamp component via the packed control signal, a mean value of the packed control signal corresponding to at least one of a brightness level and a color intensity of the lamp component.

14. A method, comprising:

receiving a binary signal having a first rate of change;

counting a first quantity of off-bits and a second quantity of on-bits of the binary signal;

comparing the first quantity of off-bits to a preselected off-value and comparing the second quantity of on-bits to a preselected on-value;

forming a packet when the first quantity of off-bits equals the preselected off-value or the second quantity of on-bits equals the preselected on-value, the packet including a set of consecutive off-bits having an amount of off-bits equal to the first quantity of off-bits and a set of consecutive on-bits having an amount of on-bits equal to the second quantity of on-bits; and outputting the packet.

15. The method of claim 14, further comprising outputting the first quantity of off-bits and the second quantity of on-bits to a packet generator, the packet generator arranged to form the packet based on the first quantity of off-bits and the second quantity of on-bits.

16. The method of claim 15, further comprising resetting the first quantity of off-bits and the second quantity of on-bits after outputting the first quantity of off-bits and the second quantity of on-bits to the packet generator.

17. The method of claim 14, further comprising temporarily storing one or more pairs of counts, wherein a pair of counts comprises a first quantity of off-bits and a second quantity of on-bits.

18. The method of claim 14, further comprising outputting the packet via a second binary signal having a constantly varying rate of change and a lesser average rate of change than the first rate of change.

19. The method of claim 14, further comprising outputting the packet via a spread spectrum output having a frequency range based on at least one of the preselected off-value and the preselected on-value.

20. The method of claim 19, further comprising adjusting an upper limit of the frequency range by adjusting the preselected on-value.

21. The method of claim 14, further comprising outputting subsequent packets based on the binary signal, having varying quantities of bits.

22. The method of claim 14, wherein the packet comprises the first quantity of off-bits followed by the second quantity of on-bits.

23. The method of claim 14, wherein the packet comprises the second quantity of on-bits followed by the first quantity of off-bits.

24. An apparatus, comprising:

one or more logic devices arranged to receive a binary control signal having a first rate of change, and to count off-bits and count on-bits of the binary control signal until a count of off-bits is equal to a preselected off-value or a count of on-bits is equal to a preselected on-value, and to generate a binary control packet based on the binary control signal, the binary control packet including a set of consecutive off-bits having a quantity of off-bits equal to the count of off-bits followed by a set of consecutive on-bits having a quantity of on-bits equal to the count of on-bits, and to output the binary control packet.

25. The apparatus of claim 24, further comprising a storage component arranged to store one or more sets comprising a count of off-bits and a count of on-bits.

26. The apparatus of claim 24, wherein the apparatus is arranged to control at least one of a brightness and a color of a lamp via the binary control packet.

* * * * *